US005853207A

United States Patent [19]

Saint Martin et al.

[11] Patent Number: 5,853,207

[45] Date of Patent: Dec. 29, 1998

[54] DEVICE FOR JOINING AND SEALING TOGETHER TWO ENCLOSURES ISOLATED FROM AN EXTERNAL ENVIRONMENT

[75] Inventors: Bernard Saint Martin, Montrouge; Christiane Prioult née Lipp, Lourdes, both of France

[73] Assignee: I D C - Isolateur Denominateur Commun, Lourdes, France

[21] Appl. No.: 490,412

[22] Filed: Jun. 15, 1995

[30] Foreign Application Priority Data

Jun. 17, 1994 [FR] France ..... 94 07430

[51] Int. Cl.[6] ..... B65D 45/30

[52] U.S. Cl. ..... 292/256.6; 292/257; 292/DIG. 33; 220/256

[58] Field of Search ..... 292/7, 34, 36, 292/46, 71, 65, 140, 159, 197, 215, 240, 256.5, 256.6, 256.75, 257, DIG. 7, 11; 220/256, 501, 502; 588/258

[56] References Cited

U.S. PATENT DOCUMENTS

| | | | |
|---|---|---|---|
| 2,394,784 | 2/1946 | Kelly | 292/240 |
| 4,047,624 | 9/1977 | Dorenbos | 214/17 |
| 4,055,274 | 10/1977 | Waldenmieier | 220/256 |
| 4,136,798 | 1/1979 | Oberstein | 220/408 |
| 4,140,240 | 2/1979 | Platts | 220/323 |
| 4,201,310 | 5/1980 | Glachet | 220/256 |
| 4,259,979 | 4/1981 | Reimpell | 220/256 |
| 4,260,312 | 4/1981 | Hackney | 414/292 |
| 4,373,547 | 2/1983 | Geis | 220/256 |
| 4,580,694 | 4/1986 | Hempelmann | 220/256 |
| 4,643,328 | 2/1987 | Lorenzelli | 220/256 |
| 4,679,835 | 7/1987 | Weinerman | 292/197 |
| 4,718,467 | 1/1988 | Di Gianfilippo | 141/105 |
| 4,883,637 | 11/1989 | McDaniels | 220/256 |
| 5,121,776 | 6/1992 | Kovach | 141/98 |
| 5,311,908 | 5/1994 | Barone | 137/881 |
| 5,421,626 | 6/1995 | Glachet | 292/256.5 |

FOREIGN PATENT DOCUMENTS

| | | |
|---|---|---|
| 0187558 | 7/1986 | European Pat. Off. . |
| 0586307 | 3/1994 | European Pat. Off. . |
| 1346486 | 11/1963 | France . |
| 1018655 | 1/1966 | United Kingdom . |

*Primary Examiner*—Steven Meyers
*Assistant Examiner*—Gary Estremsky
*Attorney, Agent, or Firm*—Young & Thompson

[57] ABSTRACT

A device for joining and sealing together two isolated enclosures has two doors. Each enclosure has one door. The two doors are provided with cooperating joining means. One enclosure is of the single use type and includes final locking means for its own door.

22 Claims, 7 Drawing Sheets

DEVICE FOR JOINING AND SEALING TOGETHER TWO ENCLOSURES ISOLATED FROM AN EXTERNAL ENVIRONMENT

BACKGROUND OF THE INVENTION

1. Field of the Invention

The invention concerns a device for joining and sealing together two enclosures normally isolated from an external environment and required to be put into communication with each other without any contact, even momentary contact, with said external environment.

The invention applies more particularly to a joining and sealing device of this kind in which the component parts are divided between a mobile or transportable container constituting one of the aforementioned enclosures and a fixed installation designed to be isolated at all times from the external environment and constituting the other of the aforementioned enclosures, the joining and sealing device enabling transfer of objects or fluids between the two enclosures without contamination of or by said external environment.

2. Description of the Prior Art

The prior art includes joining and sealing devices of the kind defined hereinabove enabling two sealed enclosures to communicate with each other, in particular for transferring products between them, without the seal between either enclosure or the combination formed by the two enclosures when connected together and the external environment being broken at any time.

A system of this kind uses two doors, each hermetically sealing an opening in the respective enclosure delimited by an annular flange. The doors have cooperating joining means enabling them to be pressed together in an hermetically sealed way before communication is established between the enclosures, in order to isolate their outside faces from each other. After the transfer from one enclosure to the other, the combination of the two doors is replaced in the respective housings in their flanges and the two enclosures are separated. In this way the outside faces of the two doors cannot be contaminated or constitute a source of contamination since they mutually isolate each other during the transfer. They can therefore come into contact with the external environment again.

Such a system is described in French patent 1 346 486, for example. That document describes a solution with particular application in the nuclear industry. The enclosures placed in communication are necessarily costly, given the intended application.

The invention concerns a new concept for such devices for joining and sealing together two isolated enclosures which can be applied in many fields in which the products manipulated are sterile and must remain so or polluting or even hazardous and must be manipulated without possibility of communication with the external environment.

SUMMARY OF THE INVENTION

The invention consists in a device for joining and sealing together two enclosures isolated from an external environment and each having a door adapted to close and hermetically seal an opening of the corresponding enclosure delimited by an annular flange, each door having an inside face in contact with the interior of the enclosure and an outside face in contact with said external environment and said doors having cooperating joining means so that they can be pressed together in an hermetically sealed way to isolate their outside faces from each other, one of said two enclosures being a single use enclosure and the device including final locking means on said single use enclosure for its own door adapted to be operated by first actuator means on the other enclosure.

In many applications at least part of the wall of the single use enclosure is made from a flexible material and is attached directly or indirectly to the rigid annular flange on which the corresponding door is mounted.

In many cases the entire enclosure, with the exception of the flange and the door, is in the form of a flexible material bag.

Other safety devices are advantageously provided and in particular the single use enclosure can include initial locking means for its own door adapted to be inhibited by second actuator means on the other enclosure.

The invention will be more clearly understood and other advantages of the invention will emerge more clearly from the following description of one embodiment of a joining and sealing device of the invention and a number of noteworthy applications of this concept, given by way of example only and with reference to the appended drawings.

DETAILED DESCRIPTION OF THE PREFERRED EMBODIMENTS

Figure 6:
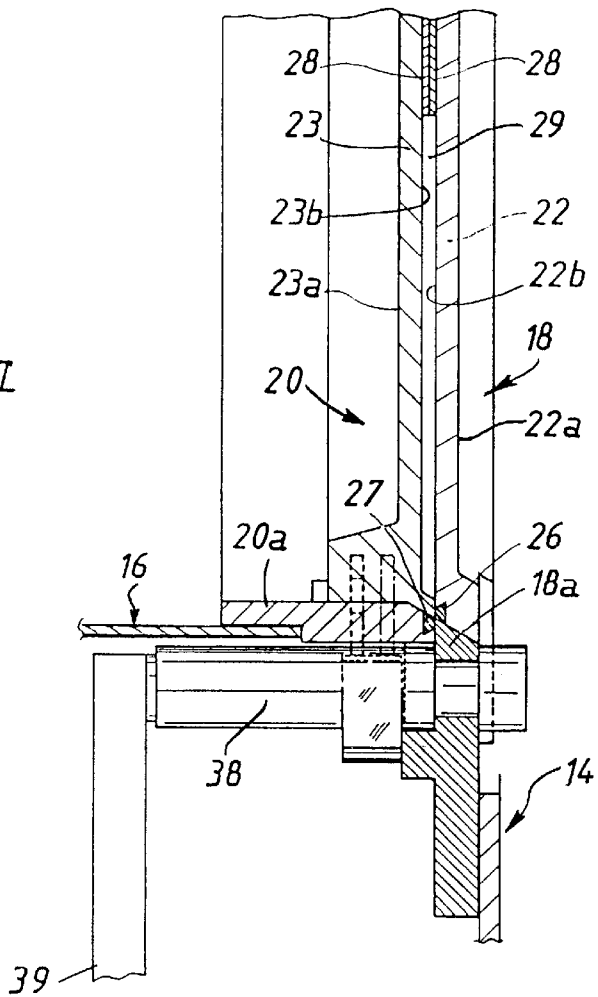
FIG. 6 is a view in section on the line VI—VI in FIG. 1.

With particular reference to FIGS. 1 through 7, some of the component parts of a device 11 for joining and sealing together two enclosures 14 and 16 are carried by the enclosure 14, which in this example is a container or a room or any other fixed installation designed to be isolated at all times from the external environment, and the remainder by the enclosure 16 which in this example is a simple container of relatively small capacity compared to that of the enclosure 14. It is important to note that the enclosure 16 is designed to be used only once. In more detail, the two enclosures 14 and 16 each include an opening 18, 20 delimited by a respective annular flange 18*a*, 20*a*. Each opening 18, 20 has a respective door 22, 23. In this example the flanges have a circular contour but this is not mandatory. The joining and sealing device is designed to control the joining and the separation of the doors 22, 23 and the placing in communication of the two enclosures by way of a procedure which avoids any contact between the content of either enclosure and the external environment. Thus the door 22 of the enclosure 14 has an inside face 22*a* normally in contact with the interior of the enclosure 14 and in any event never in contact with the external environment. The door 23 of the enclosure 16 has an inside face 23*a* which is normally in contact with the interior of the enclosure 16 and in any event is never in contact with the external environment. Likewise, the door 22 has an outside face 22*b* which is normally in contact with the external environment and in any event is never in contact with the interior of either enclosure and the door 23 has an outside face 23*b* which is normally in contact with the external environment and in any event is never in contact with the interior of either enclosure. To this end the two doors are provided with cooperating joining means for joining them one against the other in an hermetically sealed manner in order to mutually isolate their outside faces 22*b*, 23*b*. Accordingly one of the doors, in this example the door 22, carries an annular elastomer seal 26 against which a projecting external edge of the door 23 is pressed. Also, the flange 20*a* of the single use enclosure 16 has an annular seal 27 at its periphery which is pressed against the edge of the flange 18*a* of the enclosure 14, in the immediate vicinity of the seal 26. Fastening members 28 which in this example operate merely by contact are respectively attached to the center of their outside faces 22*b*, 23*b*. The fastening members 28 are magnetic or adhesive plates, for example, or means employing suckers or other like components. Each plate fixed to the center of a door is adapted to be pressed against the other. These components could be replaced by mechanical systems, for example hook systems. Also, said joining means are complemented by cam mechanisms 25 at the edge of the opening of the enclosure 14. There are three mechanisms of this kind spaced at 120° around the opening 18. Each mechanism includes a shaft 24 rotating within the thickness of the flange 18*a*, an outside cam 24A and an inside cam 24B. There is an angular offset between the angles over which the inside and outside cams are operative. The outside cam 24A locks the flange 20*a* of the single use enclosure to that of the enclosure 14. The inside cam 24B locks the door 22 of the enclosure 14 to the flange 18*a* of the latter. Each shaft carrying the two cams has an operating handle 21. The flange 20*a* includes an annular external collar 17 with three radial notches 17*a* which receive the outside cams 24A when the flange 20*a* approaches the flange 18*a*. In this situation the outside cams 24A are substantially radial and, as shown, the inside cams 24B are in a position such that they hold the door 22 firmly against its seat defined in the flange 18*a*. The inside cams 24B incorporate flats 15 such that when the handles are turned the outside collar 17 of the flange 20*a* is clamped against the flange 18*a* before the door 22 is released by releasing the inside cams.

It is clear from the above description that, as soon as the operation of joining the two openings is commenced the two doors are pressed together in an hermetically sealed way, without rotation of one relative to the other and in such a manner that the outside faces 22*b*, 23*b* which were in contact with the external environment are isolated from each other with only a very thin and hermetically sealed space 29 between them (FIG. 6). The two faces 22*b*, 23*b* are therefore isolated and the doors remain joined together whilst being removable together from their seats, to enable transfers between the two enclosures. At the end of the transfer operation the two doors are replaced together in their respective openings before they are re-attached to their respective flange and then separated from each other.

Figure 1:
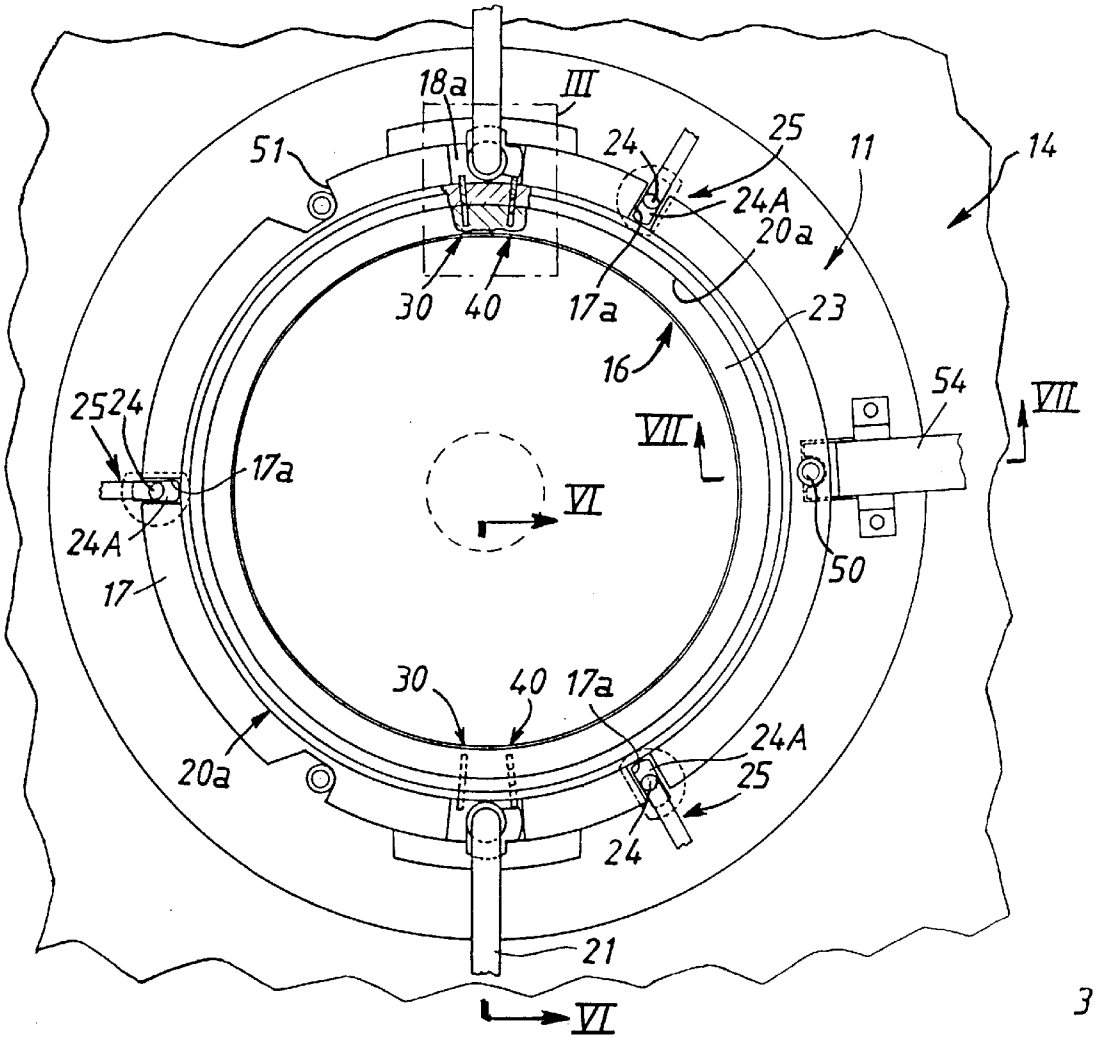
FIG. 1 is a partly cut away front view of a device for joining and sealing together two enclosures isolated from an external environment and shows the joining means on the outside of a fixed enclosure.
Figure 7:
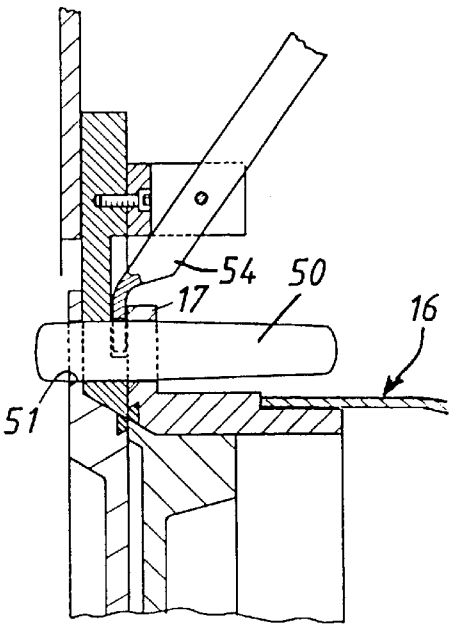
FIG. 7 is a view in section on the line VII—VII in FIG. 1.
Figure 2:
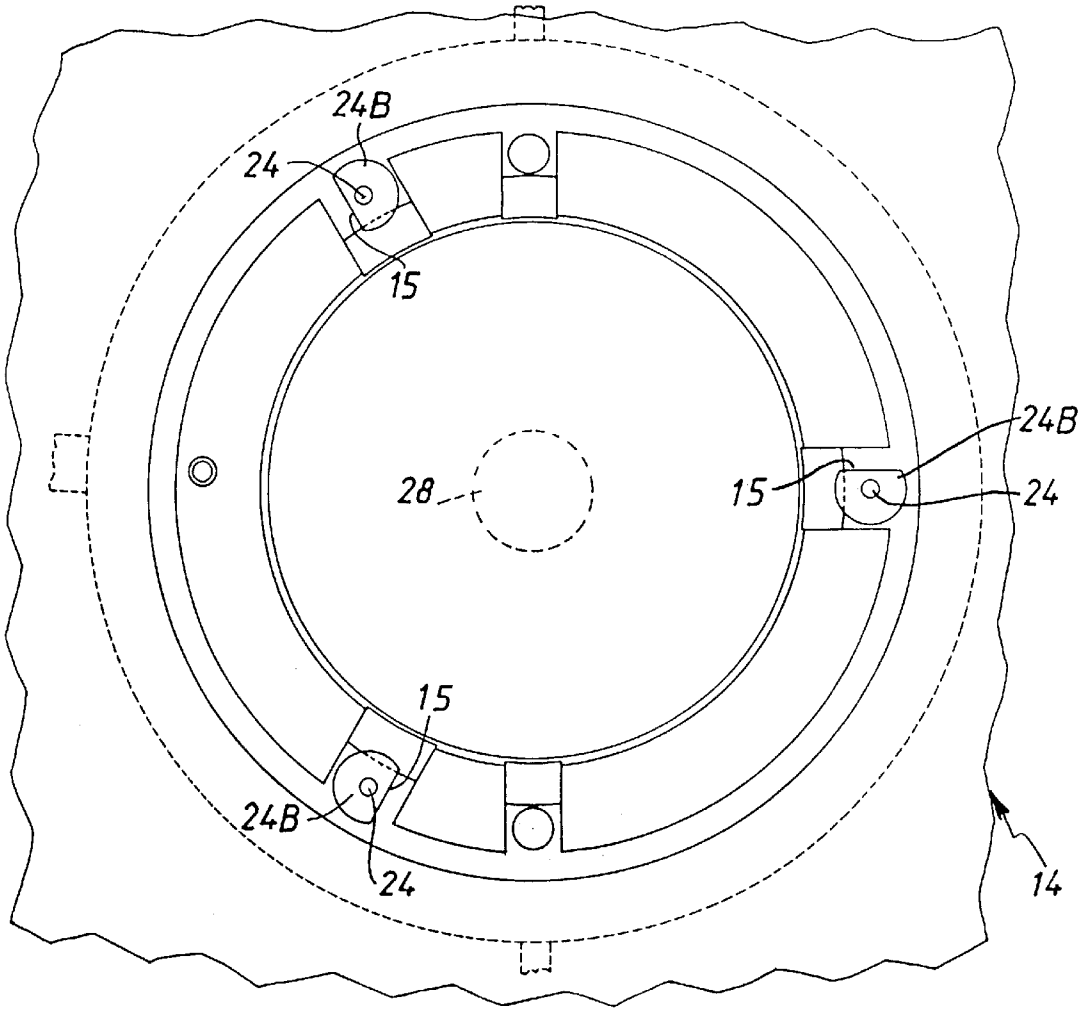
FIG. 2 is a view analogous to FIG. 1 showing the joining means as seen from inside the fixed enclosure.

As previously mentioned, the enclosure 16 is of the single use type and accordingly includes final locking means for its own door 23 controlled by first actuator means on the other enclosure. In more detail, said final locking means include at least one arrangement 30 in the door 23 and the flange 20*a* and comprising a hole 32 through the flange 20*a*, a blind hole 34 in the thickness of the door 23 of the single use enclosure 16, normally aligned with the hole 32 in the flange, and a pin 36 or the like inserted in the hole 32 and the length of which is greater than the thickness of the flange 20*a*. As shown in FIG. 1, two arrangements 30 of this kind are provided at diametrally opposite positions. Before actuation of said final locking means, said pin 36 projects out of the flange 20*a* and is not inserted in the blind hole 34.

Said first actuator means further include, near each pin 36, a shaft member 38 turning about its own axis in the flange 18*a* near the edge of the opening 18 of the enclosure 14. This shaft carries a cam 37 adapted to cooperate with the adjacent pin 36 to depress it in the blind hole 34. The shaft 38 has a handle 39 for operating the cam 37. The single use enclosure 16 further includes initial locking means for its own door 23 adapted to be inhibited by second actuator means on the enclosure 14. The initial locking means include at least one arrangement 40 in the door 23 and the flange 20*a* and comprising a hole 42 through the flange 20*a*, a blind hole 44 in the thickness of the door 23 of the single use enclosure 16 normally aligned with the hole 42 in the flange, an inside pin 46 and an outside pin 47, the two pins being in alignment with each other in the two holes. As before, two such arrangements 40 are provided at diametrally opposite positions.

Figure 4:
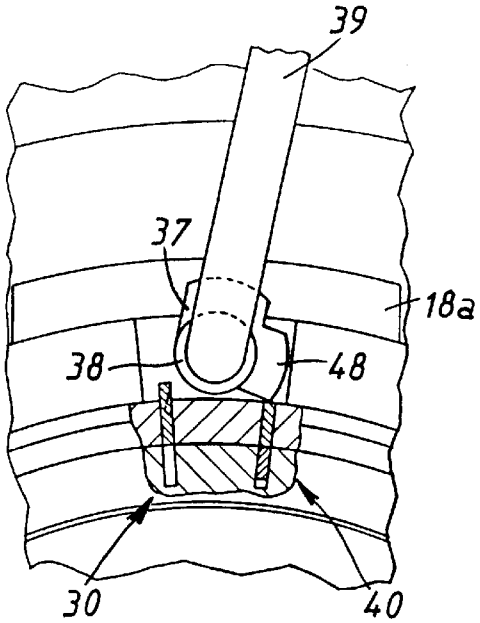
FIG. 4 is a view analogous to FIG. 3 showing an operation to release the door of the mobile enclosure.
Figure 3:
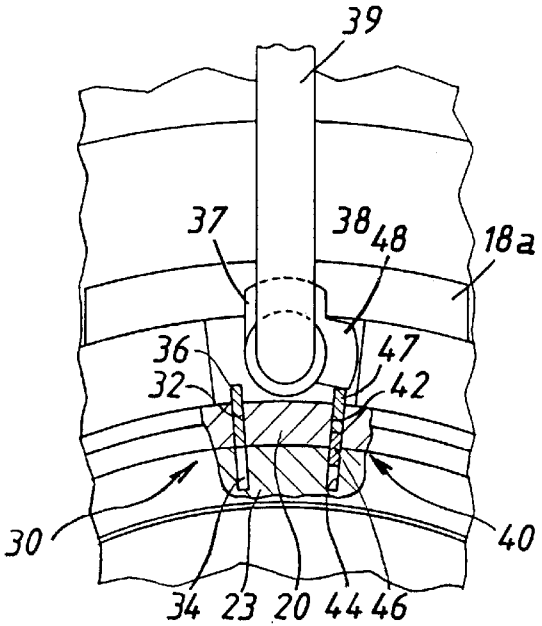
FIG. 3 shows the detail III in FIG. 1 to a larger scale.

Before the single use enclosure is used, the inside pin 46 is inserted in the flange 20*a* and in the door 23 and the outside pin 47 projects out of the flange 20*a* (FIG. 3). The lengths of the pins 46, 47 are such that their ends in contact are at the interface between the flange 20*a* the door 23 (FIG. 4) when said second actuator means operate on the outside pin 47. The second actuator means include a cam 48 adapted to cooperate with the pin 47 to depress it in the flange 20*a* (FIG. 4). This cam is attached to the shaft 38 with its handle 39. In other words, as shown clearly in FIGS. 1 and 3 through 5, said first and second actuator means are combined together and divided between two diametrally opposite assemblies. At these locations the collar 17 has cut-outs to receive the shafts 38 and the corresponding cams 37, 48. The pins are hermetically sealed to the walls of the holes in which they are fitted, forming a kind of plug.

As shown in FIG. 6, the edges of the flanges 18*a*, 20*a* and those of the doors 22, 23 which respectively mount in them are conical or have conical portions. The conical parts of the flanges thus form annular seats for said doors. Said conical parts have the same cone angle and the diameters of the outside faces 22*b*, 23*b* are the same so that when joined together the doors have only one conical part with no discontinuity. Likewise, the ends of the flanges which come into contact have the same diameter so that the conical parts of the flanges are aligned when they are joined together and form a single conical section with no discontinuity. This particular configuration of the edges of the flanges and the doors facilitates demounting and replacement of the double door.

Figure 5:
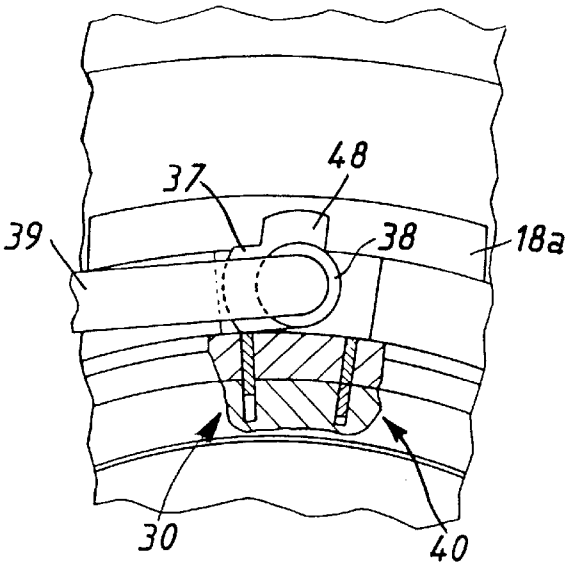
FIG. 5 is a view analogous to FIG. 4 showing final locking of the door of the mobile enclosure.

The flange 20*a* is accurately located relative to the flange 18*a* in the circumferential direction by three pins 50 fastened to the flange 18*a* and spaced at 120° in the circumferential direction. They cooperate with notches 51 in the collar 17. At least one of the pins 50 passes through the wall of the flange 18*a* into the enclosure 14. A peripheral collar on the door 22 includes a hole 51 or a similar cut-out for accurate circumferential location of the two doors relative to the joined flanges when the two doors are replaced before separating the two enclosures. This guarantees alignment of the two holes 32 and 34 of each arrangement 30 for final and permanent locking of the door 23 to the flange 20*a* of the single use enclosure 16 (FIG. 5). Replacement of the two doors is facilitated if the enclosure 14 has a flexible material sleeve beside the opening 18 through which an operator can insert an arm and therefore work from inside the enclosure 16. The flange 18*a* is provided with a lever 54 one end of which fits under the collar 17 when the two enclosures are joined together (FIG. 7) to facilitate subsequent separation of the two flanges when the two enclosures are separated.

In accordance with another highly advantageous feature of the invention, the single use enclosure 16 or at least part of it is made from a flexible material. The flexible material part is attached to the rigid annular flange 20*a* on which the door 23 is mounted. In various embodiments the enclosure 16 can be a simple bag of flexible material joined (for example welded) to the flange 20*a* (see FIG. 6). The entire enclosure 16 is made from low-cost materials. For example, the flange 20*a* and the door 23 can be made from a rigid plastics material and the remainder of the enclosure (forming the flexible bag) can be made from a flexible plastics material.

Coupling and decoupling of the two enclosures will now be described with reference to FIGS. 3 through 5.

Prior to use, the arrangements 30 and 40 of the single use enclosure are in the configuration shown in FIG. 3. With the lever 39 oriented radially, there is nothing to oppose positioning of the flange 20*a* on the flange 18*a* and the joining of the two doors 22, 23. However, the position of the pins 46 prevents opening of the door 23. First of all, the operator operates the three cam mechanisms 25 which clamps the flange 20*a* firmly to the flange 18*a*, and then unlocks the door 22. The operator then turns the two handles 39 from the position shown in FIG. 3 to that shown in FIG. 4. From this point onwards the point of contact between the two pins 46 and 47 is at the interface between the flange 20*a* and the door 23 and the latter can be separated from the flange 20*a* at the same time as the door 22 to which it is assembled. The required operations can then be carried out, including transfers between the two enclosures. After this, the two doors 22 and 23 are replaced, still joined together, and the operator turns the handles 39 again to move the cams 37 to the position shown in FIG. 5, which depresses the pins 36 and locks the door 23 permanently to the flange 20*a* of the enclosure 16. After this all that is required is to operate the cam mechanisms 25 again to separate the two enclosures, each closed by its own door.

Figure 9:
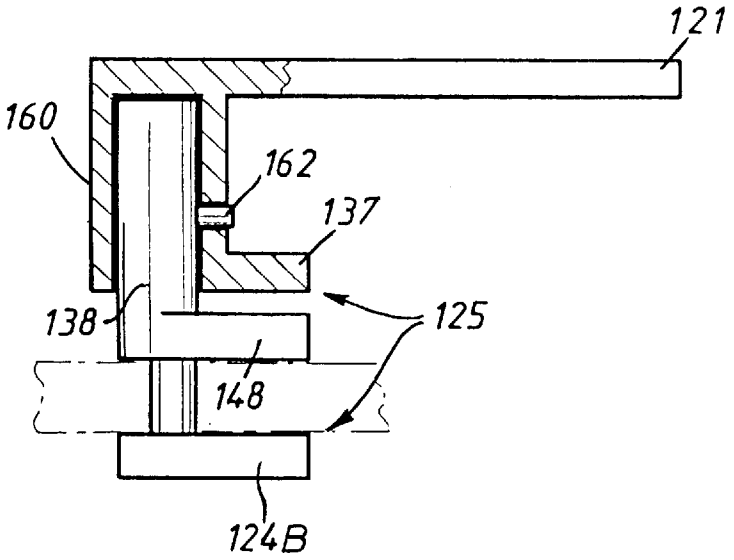
FIG. 9 is a part sectional view showing the structure of an operating handle and associated cams in the FIG. 8 embodiment of the invention.
Figure 10:
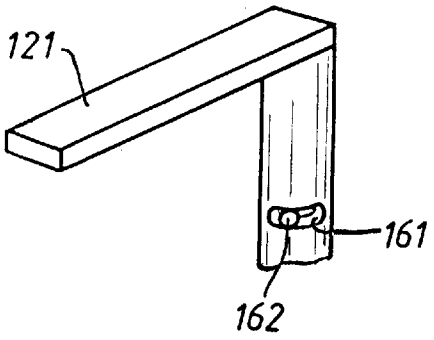
FIG. 10 is a perspective view of part of the arrangement from FIG. 9.
Figure 8:
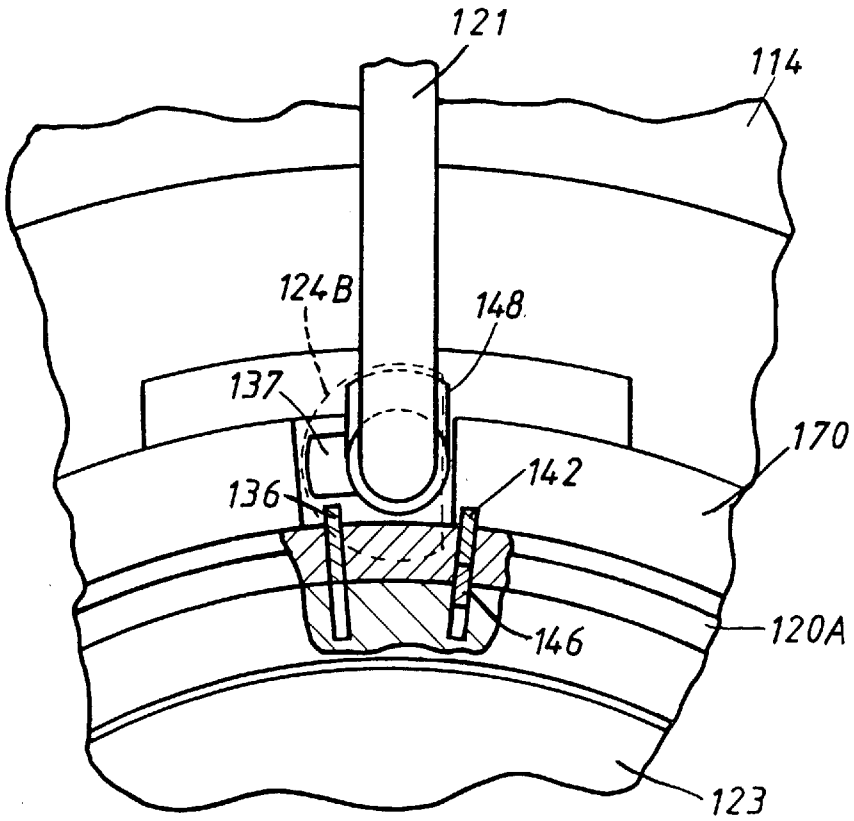
FIG. 8 is a cut away partial front view of one embodiment of a device for joining and sealing together two enclosures isolated from an external environment, showing the joining and locking means of the outside of a fixed enclosure.

FIGS. 8 through 10 show an embodiment of the invention in which structural components analogous to those of FIGS. 1 through 5 are identified by the same reference numbers increased by 100. This embodiment. differs from the previous embodiment in that the joining means, in particular the cam mechanisms 125, are combined with said first actuator means including a cam 137 and with said second actuator means including a cam 148. This simplifies the joining and locking/unlocking operations and considerably reduces the risk of misoperation.

In more detail, in this example, there are only two of the cam mechanisms shown in FIG. 1 and they are combined with the shafts 138 and the handles 121 of said first and second actuator means which were already combined together in the first example.

The inside and outside cams that said assembly means previously included are moved to the shafts 138, an inside cam 124B being fitted at the inside end of each of them and the outside cams being in this embodiment combined with the cams 148 of said second actuator means for the previously mentioned initial locking means 140. The cams 148 (or 124A) and 124B are attached to the shaft 138 and, as in the previous example, there is an angular offset between the angles over which they are operative. Their function is unchanged. The outside cams 124A fasten the flange 120*a* of the single use enclosure to that of the other enclosure and the inside cams 124B attach the door of the enclosure 114 to the flange of the latter.

The cams 148 can cooperate with the pins 142 of said initial locking means at the end of their travel in one direction of rotation of the operating handles 121.

However, the operating handles 121 are not joined directly to the corresponding shaft 138; each is attached to an operating sleeve 160 which fits over the shaft 138. The sleeve carries a cam 137 of said first actuator means adapted to cooperate with a pin 136 of said final locking means. The sleeve 160 has a coupling slot 161 and the shaft 138 has a pin 162 projecting perpendicularly to its rotation axis and inserted in said coupling slot 161. With this particular arrangement each handle 121 is able to assume a neutral position and two extreme positions respectively corresponding to unlocking and final locking of the door 123. By moving each handle from the neutral position (FIG. 8) to the first extreme position, the operator first attaches the single use enclosure (through cooperation of the cam 148 with the collar 170) and then, at the end of travel, releases the door of the enclosure 114 and unlocks the door 123. After use the operator moves each handle to its other extreme position and the coupling as described permanently locks the door 123 of the single use enclosure before the cam 148 is disengaged from the flange of the single use enclosure. The same movement causes the door of the enclosure 114 to be locked by the cams 124B. To remove the single use enclosure the operator returns the handles 121 to their neutral position.

Figure 11:
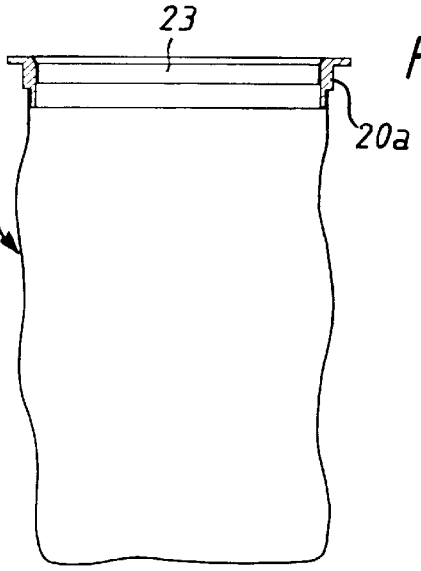
FIG. 11 is a highly schematic view showing an application of the sealing and joining device of the present invention.

FIGS. 11 through 22 show mobile single use enclosures, which usually have a flexible wall or a flexible wall portion and specific features and/or equipments for a particular function. In these figures, structural components analogous to those described with reference to FIGS. 1 through 7 are identified by the same reference numbers. FIG. 11 shows a single use enclosure 16 with a flexible wall in the form of a sealed bag attached to the flange, the latter being closed by the door 23. The flange and the door are naturally equipped with pins for initial unlocking and subsequent final and permanent locking. The flexible material bag part can be made from a totally impermeable plastics material, in particular if the enclosure is intended to receive contaminated or polluting products and is intended to be destroyed with its contents, for example by incineration. The wall can instead be porous, enabling sterilization in an autoclave before or after use.

In a different embodiment of the invention the bag joined to the flange is made from a water soluble material. It is then possible to recover soiled and/or contaminated clothing, to place them in the single use enclosure and to place the latter in a washing machine. The water soluble bag dissolves at the start of the washing cycle and the clean clothing can be recovered at the end of the washing cycle.

Figure 12:
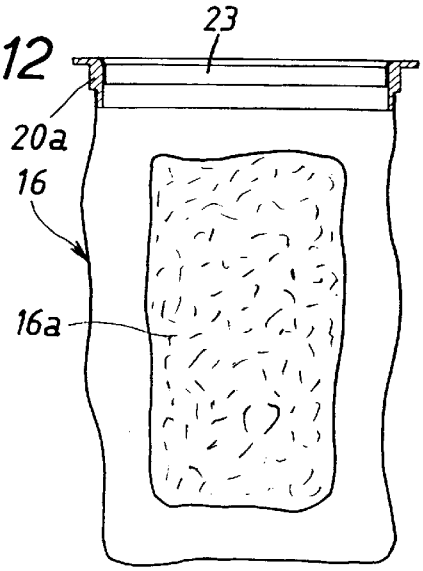
FIG. 12 is a highly schematic view showing an application of the sealing and joining device of the present invention.

The embodiment of the invention shown in FIG. 12 is similar to that shown in FIG. 11 but only one part 16*a* of the flexible wall is made from a porous material enabling sterilization by impregnation with a gas such as ethylene oxide. The sterilization is effected by placing the enclosure in a pressurized ethylene oxide atmosphere.

Figure 13:
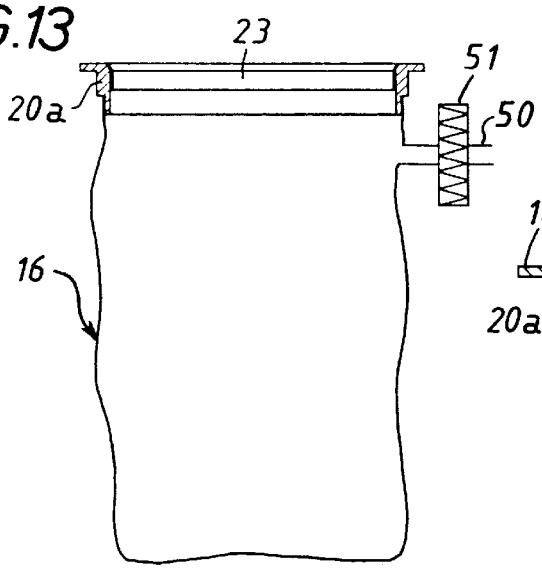
FIG. 13 is a highly schematic view showing an application of the sealing and joining device of the present invention.

The embodiment of the invention shown in FIG. 13 also enables sterilization by ethylene oxide. In this case said single use enclosure includes a connector 50 for coupling it to a source of ethylene oxide gas or some other sterilizing gas. A membrane filter 51 is provided between the connector 50 and the internal volume of the enclosure 16. This filter also forms a stopper to prevent subsequent contamination of the interior volume of the enclosure.

Figure 14:
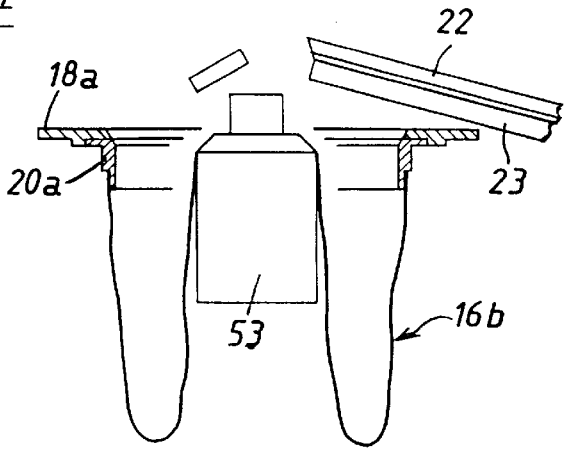
FIG. 14 is a highly schematic view showing an application of the sealing and joining device of the present invention.

In the example shown in FIG. 14 the single use enclosure has a flexible material part 16*b* and a rigid flask 53. The flexible material part is sealed to the flask and to the flange 20*a*. In this way it is possible to recover sharp or pointed objects (lancets, syringes, etc) without risk of the single use enclosure being punctured.

Figure 15:
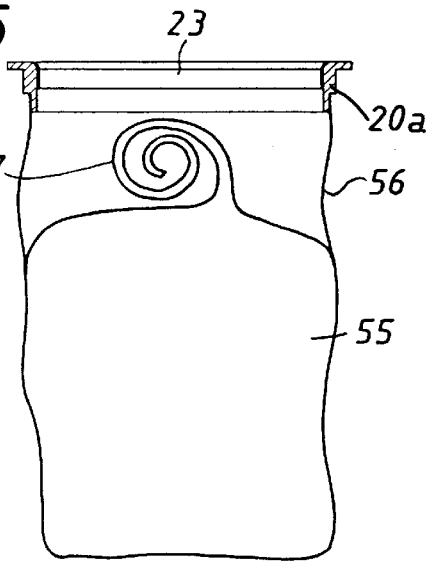
FIG. 15 is a highly schematic view showing an application of the sealing and joining device of the present invention.

The example shown in FIG. 15 relates to a bag 55 containing powder. The flexible material part includes at least one tubular sleeve 56 connected between the flange and the bag. This part can also be a bag, as in the example shown in FIG. 8 enclosing another bag containing the powder. The single use enclosure or the inner bag has a flexible material inner sleeve 57 to facilitate pouring out the powder. Note that in this example, because the part which contains the powder is joined to the flange by the flexible material sleeve, coupling to the fixed enclosure is not impeded by the weight of the bag of powder, which is often considerable.

Figure 16:
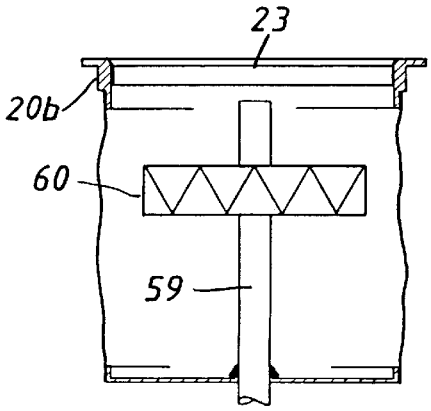
FIG. 16 is a highly schematic view showing an application of the sealing and joining device of the present invention.

FIG. 16 shows a further embodiment of the invention enabling transfer of a solution that can be sterilized by filtration. To this end a connecting tube 59 passes through and is sealed to the wall of the single use enclosure 16 and is connected to a filter 60 accommodated inside said single use enclosure. This enclosure can therefore be connected to a fixed enclosure containing the liquid product to be sterilized by filtration from which the product is extracted and filtered. The filter 60 is discarded and/or destroyed inside said single use enclosure after the liquid has been transferred.

Figure 17:
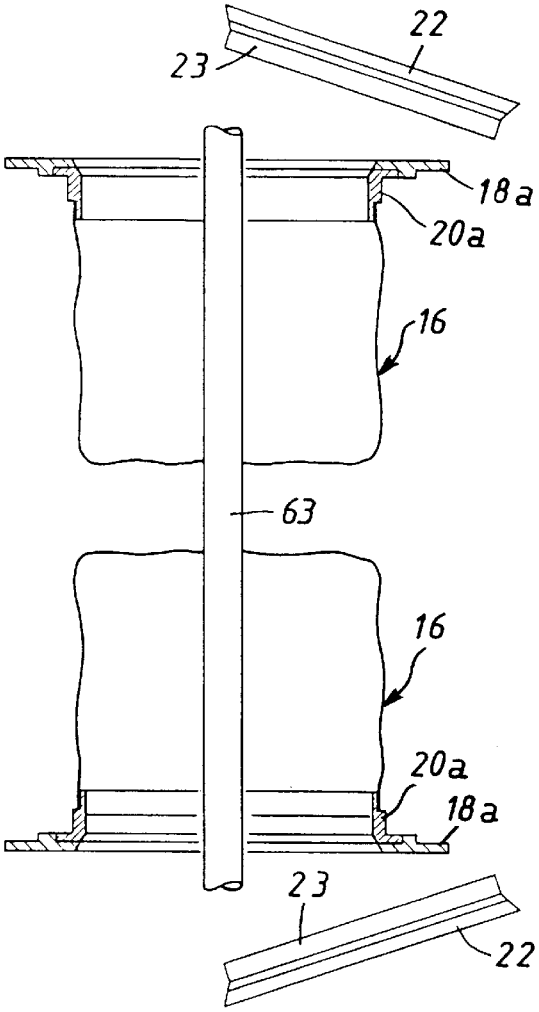
FIG. 17 is a highly schematic view showing an application of the sealing and joining device of the present invention.

FIG. 17 shows another embodiment of the invention including two flanges 20*a* with respective doors 23 adapted to be connected to other enclosures 14. In the FIG. 17 example, the two parts are linked by a tube 63 which forms part of a fluid circuit. Accordingly, a flow of fluid can be established between two enclosures that are normally isolated from each other, the single use enclosure containing the connecting tube 63 being destroyed after use.

Figure 18:
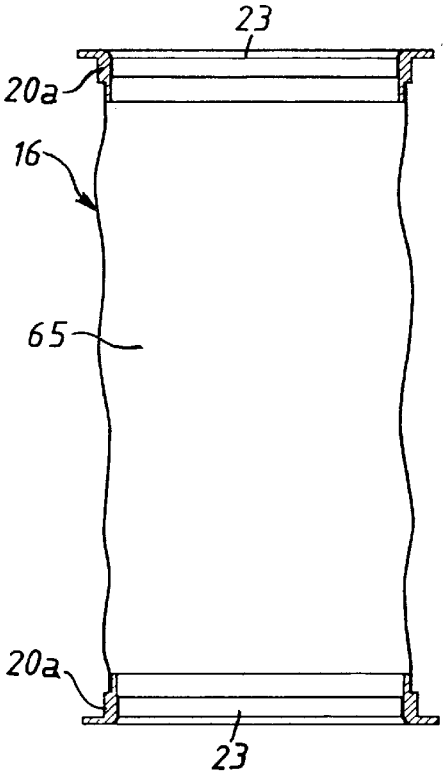
FIG. 18 is a highly schematic view showing an application of the sealing and joining device of the present invention.

The FIG. 18 example also shows a single use enclosure including two flanges 20*a* with respective doors 23 adapted to be fixed to other, fixed enclosures. In this example the flexible material part is connected to the two flanges by its respective ends to define a communication sleeve 65 between the two fixed enclosures.

Figure 19:
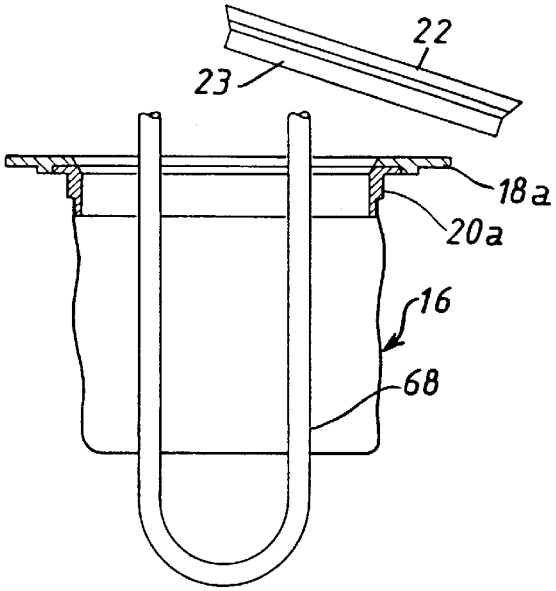
FIG. 19 is a highly schematic view showing an application of the sealing and joining device of the present invention.

In the FIG. 19 example the single use enclosure includes a flexible conduit member 68 both ends of which discharge into the flexible material bag. A U-shape section of said conduit element extends outside the bag. This device constitutes part of a disposable peristaltic pump. The two ends of the flexible conduit can be connected to two parts of a circuit established inside the fixed enclosure while the motor and the cams of the peristaltic pump are coupled to the part of the flexible conduit outside the bag. After use the two ends of the flexible conduit are confined within the single use enclosure and the whole can be destroyed.

Figure 20:
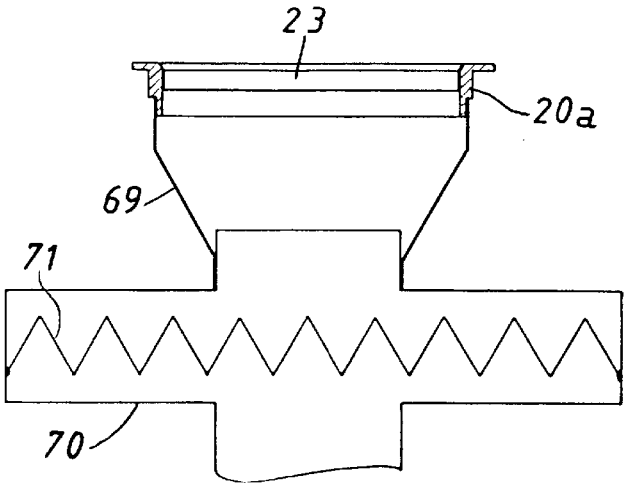
FIG. 20 is a highly schematic view showing an application of the sealing and joining device of the present invention.

FIG. 20 shows a single use enclosure which does not have a flexible material wall but which constitutes an air filter or, more generally, a single use gas filter adapted to be connected to a fixed enclosure. The flange 20*a* is connected by a rigid tube 69 to a casing 70 containing a dry low-pressure air filter 71.

Figure 21:
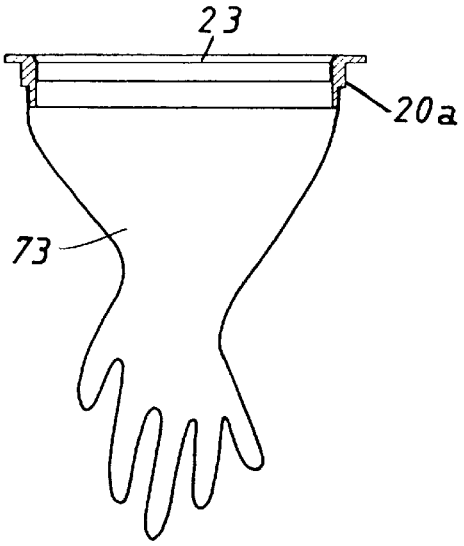
FIG. 21 is a highly schematic view showing an application of the sealing and joining device of the present invention.
Figure 22:
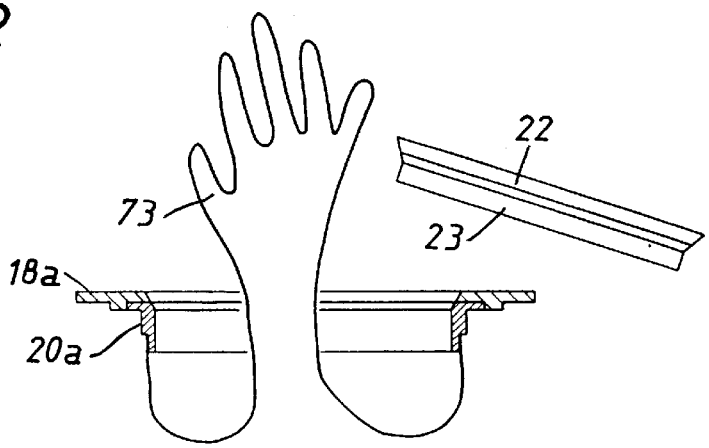
FIG. 22 is a highly schematic view showing an application of the sealing and joining device of the present invention.

FIGS. 21 and 22 shows a final embodiment of the invention in which the flexible material part of the single use enclosure comprises an inside-out glove 73 (FIG. 21) connected by the cuff to a flange 20*a* with its door 23. When a device of this kind is joined to the opening of another, fixed enclosure 14, the user can insert his hand into the glove 73 and so work inside the fixed enclosure (FIG. 22).

There is claimed:

1. A device or joining and sealing together two enclosures whose interiors are isolated from an external environment, one of the two enclosures being a single use enclosure that is not reused, the device comprising:

two flanges, each of said flanges being adapted to be attached to an opening of a respective one of the enclosures;

two doors, one for each of the two enclosures, each said door being in a respective one of said annular flanges and adapted to close and hermetically seal the opening to its respective enclosure's interior when mounted on it respective enclosure, each said door having an outside face for contact with the external environment;

said doors having cooperating joining means for hermetically sealing said outside faces to each other so that said outside faces are not exposed to the interiors of the enclosures when either of said doors is opened;

locking means for irreversibly locking closed said door of the single use enclosure; and first actuator means for being mounted on the other of the enclosures and for actuating said locking means.

2. The device of claim 1, wherein said locking means comprises a first hole in said flange of said door for the single use enclosure and a first blind hole in said door for the single use enclosure in registration with said first hole when said door for the single use enclosure is closed, and a first pin longer than a depth of said first hole inserted into said first hole, and wherein said first actuator means comprises a pivoting cam structured and arranged to push said first pin into said first and first blind holes when in registration to irreversibly lock said door for the single use enclosure.

3. The device of claim 1, further comprising an initial lock that comprises a second hole in said flange of said door for the single use enclosure and a second blind hole in said door for the single use enclosure in registration with said second hole when said door for the single use enclosure is closed, and two second pins for insertion into said second and second blind holes, said two second pins having lengths so that their ends are in contact at an interface between said flange and said door when said second pins are completely inserted into said second and second blind holes, and further comprising a second actuator structured and arranged to push said second pins completely into said second and second blind holes to unlock said door for the single use enclosure.

4. The device of claim 3, wherein said locking means comprises a first hole in said flange of said door for the single use enclosure and a first blind hole in said door for the single use enclosure in registration with said first hole when said door for the single use enclosure is closed, and a first pin longer than a depth of said first hole inserted into said first hole, and further comprising a pivoting arm, wherein said first actuator means comprises a cam on said pivoting arm structured and arranged to push said first pin, and said second actuator means comprises a second cam on said pivoting arm structured and arranged to push said second pins.

5. The device of claim 1, wherein said locking means comprises a first pin for insertion into a hole in said door of the single use enclosure, and further comprising an initial lock with at least one second pin for insertion into said door of the single use enclosure, and wherein said first actuator means comprises a pivoting arm with a first cam for actuating said first pin and a second cam for actuating said second pin.

6. A device for joining and sealing together two enclosures whose interiors are isolated from an external environment, the device comprising:

two flanges, each of said flanges being adapted to be attached to an opening of a respective one of the enclosures;

two doors, one for each of the two enclosures, each said door being in a respective one of said annular flanges and adapted to close and hermetically seal the opening to its respective enclosure's interior when mounted on its respective enclosure, each said door having an outside face for contact with the external environment;

said doors having cooperating joining means for hermetically sealing said outside faces to each other so that said outside faces are not exposed to the interiors of the enclosures when either of said doors is opened; and an initial lock that comprises a hole in said flange of one said door and a blind hole in said one door in registration with said hole when said one door is closed, and two pins inserted into said holes, said two pins having lengths so that their ends are in contact at an interface between said flange and said one door when said pins are completely inserted into said holes, and further comprising an actuating arm structured and arranged to push said pins completely into said holes to unlock said one door.

7. The device of claim 6, further comprising an irreversible lock that comprises a further hole in said flange of said one door and a further blind hole in said one door in registration with said further hole when said one door is closed, and a further pin longer than a depth of said further hole inserted into said further hole, and wherein said actuating arm further comprises a cam structured and arranged to push said further pin into said further blind hole to irreversibly lock said one door.

8. A device for joining and sealing together two enclosures whose interiors are isolated from an external environment, one of the two enclosures being a single use enclosure that is not reused, the device comprising:

two flanges, each of said flanges being adapted to be attached to an opening of a respective one of the enclosures;

two doors, one for each of the two enclosures, each said door being in a respective one of said annular flanges and adapted to close and hermetically seal the opening to its respective enclosure's interior when mounted on its respective enclosure, each said door having an outside face for contact with the external environment, said two doors having cooperating joining means for pressing together and joining said two doors to hermetically seal their respective outside faces to each other so that said outside faces are not exposed to the interiors of the two enclosures when either of said two doors is opened, said joining means comprising cam mechanisms adapted to be attached to the enclosure other than the single use enclosure and spaced around said annular flange of the other enclosure, each said cam mechanism comprising two cams on a pivot arm that have operating ranges that are angularly offset, one of said two cams adapted to be located externally with respect external to the other enclosure for attaching said annular flange of the single use enclosure to said angular flange of the other enclosure and a second of said two cams adapted to be located internally with respect internal to the other enclosure for attaching said door of the other enclosure to said annular flange thereof;

locking means for irreversibly locking closed said door of the single use enclosure; and first actuator means for being mounted on the other of the two enclosures and for actuating said locking means.

9. The device of claim 8, wherein said locking means comprises a first pin for insertion into a hole in said door of the single use enclosure, and further comprising an initial lock with at least one second pin for complete insertion into said door of the single use enclosure, and wherein said external cam is for actuating said second pin, and further comprising a further external cam on a sleeve over said pivot arm for actuating said first pin, said sleeve including a coupling slot and said pivot arm including a pin projecting into said coupling slot.

10. A single use enclosure whose interior is isolated from an external environment, the single use enclosure comprising:

a door in an annular flange in an opening to the single use enclosure's interior, said door being structured and arranged to close and hermetically seal said opening and having an outside face for contact with the external environment;

said door having sealing means for hermetically sealing said outside face to a second door so that said outside face is not exposed to the interior of the single use enclosure when said door is opened; and locking means for irreversibly locking closed said door and for being actuated by an actuator separate from said single use enclosure.

11. The enclosure of claim 10, wherein at least a part of a wall of said single use enclosure comprises a porous material.

12. The enclosure of claim 10, wherein said single use enclosure includes a connector for joining it to a supply of a sterilizing gas and a membrane filter between said connector and the interior of said enclosure.

13. The enclosure of claim 10, wherein a wall of said single use enclosure connected to said flange comprises a water soluble material.

14. The enclosure of claim 10, wherein said single use enclosure has a rigid part opening into the interior of said enclosure and a flexible part joined to said flange and to said rigid part.

15. The enclosure of claim 10, wherein at least one part of said single use enclosure comprises a flexible material sleeve connected to said flange and said single use enclosure further includes a flexible material internal sleeve.

16. The enclosure of claim 15, wherein a connecting tube passes through and is sealed to the wall of said single use enclosure and a filter connected to said tube is accommodated in said single use enclosure.

17. The enclosure of claim 10, wherein said single use enclosure includes at least two flanges with respective doors adapted to be connected to respective other enclosures.

18. The enclosure of claim 17, wherein said single use enclosure is in two parts provided with a respective flange and with a respective door and said two parts are joined by a tube forming part of a fluid circuit.

19. The enclosure of claim 10, comprising a flexible conduit member both ends of which discharge into said single use enclosure and a portion of which lies outside the latter and can be coupled to a peristaltic pump.

20. The enclosure of claim 10, wherein a flexible material part of said single use enclosure is in the form of a glove.

21. The enclosure of claim 10, wherein said flange of said single use enclosure carries a casing containing a filter.

22. A combination of a single use enclosure whose interior is isolated from an external environment and a door lock actuator for the enclosure:

the single use enclosure comprising;

a door in an annular flange in an opening to the single use enclosure's interior, said door being structured and arranged to close and hermetically seal said opening and having an outside face for contact with the external environment, said door having sealing means for hermetically sealing said outside face to a second door so that said outside face is not exposed to the interior of the single use enclosure when said door is opened, locking means for irreversibly locking closed said door, and said door lock actuator comprising a first actuator mounted on another enclosure to which said single use enclosure is to be attached for actuating said locking means.

* * * * *